US006847023B2

(12) United States Patent
Han et al.

(10) Patent No.: US 6,847,023 B2
(45) Date of Patent: Jan. 25, 2005

(54) MAGNETRON FOR MICROWAVE OVENS

(75) Inventors: Yong-Woon Han, Kunpo (KR); Seong-Deog Jang, Suwon (KR); Han-Seong Kang, Suwon (KR); Joo-Yong Yeo, Suwon (KR); Dae-Sung Han, Hwasung (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 9 days.

(21) Appl. No.: 10/361,820

(22) Filed: Feb. 11, 2003

(65) Prior Publication Data

US 2004/0060933 A1 Apr. 1, 2004

(30) Foreign Application Priority Data

Sep. 26, 2002 (KR) ..... 10-2002-0058413

(51) Int. Cl.[7] ..... H05B 6/64; H01J 25/50

(52) U.S. Cl. ..... 219/756; 315/39.51

(58) Field of Search ..... 219/756, 757, 219/758, 761, 678, 762, 763; 333/227; 315/39.51–39.77

(56) References Cited

U.S. PATENT DOCUMENTS

| | | | | | |
|---|---|---|---|---|---|
| 4,705,989 | A | * | 11/1987 | Takada et al. | 315/39.51 |
| 4,720,658 | A | * | 1/1988 | Tsuzurahara | 315/39.51 |
| 4,891,557 | A | * | 1/1990 | Nobue et al. | 315/39.51 |
| 6,717,365 | B2 | * | 4/2004 | Lee et al. | 315/39.51 |

FOREIGN PATENT DOCUMENTS

| | | | | |
|---|---|---|---|---|
| JP | 01-286231 | | 11/1989 | |
| JP | 03-283234 | | 12/1991 | |
| JP | 20002268739 | A * | 9/2000 | H01J/23/04 |

* cited by examiner

*Primary Examiner*—Daniel Robinson
(74) *Attorney, Agent, or Firm*—Staas & Halsey LLP

(57) ABSTRACT

A magnetron for microwave ovens including a second insulator interposed between a connection part and a bottom of a yoke to form a relatively lengthened insulation distance, or a molded insulating plate attached to a bottom of the filter box to reduce a distance between the connection part and a bottom of the filter box. In the magnetron, an entire height of the magnetron is reduced, so that a miniaturization of the magnetron can be implemented and a design of a product including the magnetron, such as a microwave oven, can be freely carried out, thus allowing an appearance of the product to be variously designed.

30 Claims, 5 Drawing Sheets

MAGNETRON FOR MICROWAVE OVENS

CROSS-REFERENCE TO RELATED APPLICATION

This application claims the benefit of Korean Application No. 2002-58413, filed Sep. 26, 2002, in the Korean Intellectual Property Office, the disclosure of which is incorporated herein by reference.

BACKGROUND OF THE INVENTION

1. Field of the Invention

The present invention relates generally to a magnetron for microwave ovens, and more particularly, to a magnetron for microwave ovens, which is provided with a filter box having a reduced height.

2. Description of the Related Art

In general, magnetrons are widely used to generate microwaves in home appliances, such as in microwave ovens, as well as in industrial applications, such as in high-frequency heating apparatuses, in particle accelerators and in radars.

The general construction of such a magnetron is described with reference to FIG. 1.

As shown in FIG. 1, in a magnetron 100, a plurality of vanes 102 that comprise a positive polar section together with a positive polar cylinder 101 are radially arranged at regular intervals in the positive polar cylinder 101 to form a cavity resonator, and an antenna 103 is connected to one of the vanes 102 to induce microwaves to an outside of the magnetron 100. Further, a filament 106 having a coil spring form is disposed along a central axis of the positive polar cylinder 101, and an activating space 107 is provided between radially inside ends of the plurality of vanes 102 and the filament 106. An upper shield 108 and a lower shield 109 are attached to a top and a bottom of the filament 106, respectively. A center lead 110 is fixedly welded to a bottom of the upper shield 108 while passing through a through hole of the lower shield 109 and the filament 106. A side lead 111 is welded to a bottom of the lower shield 109. The center lead 110 and the side lead 111 are electrically connected to first and second terminals 104*a* and 104*b*, respectively, and the first and second terminals 104*a* and 104*b*, respectively, being connected to an external power source (not shown). Thus, in the magnetron is formed an electrically closed circuit in which the first terminal 104*a*, the center lead 110, the upper shield 108, the filament 106, the lower shield 109, the side lead 111 and the second terminal 104*b* are electrically connected to each other in sequence. Other parts of the magnetron 100 except for parts comprising the electrically closed circuit are grounded. First ends of first and second choke coils 105*a* and 105*b* are electrically connected to the terminals 104*a* and 104*b*, respectively, while second ends of the first and second choke coils 105*a* and 105*b* are electrically connected to respective terminals of a capacitor (not shown), which is mounted on a side wall of a filter box 113 accommodating first ends of the center and the side leads 110 and 111, respectively, and the first and second terminals 104*a* and 104*b* or the first and second choke coils 105*a* and 105*b*. The filter box 113 is made of a metallic material to eliminate noise components irradiated through the center and side leads 110 and 111, and is grounded. Further, an upper permanent magnet 112*a* and a lower permanent magnet 112*b* are provided to apply magnetic flux to the activating space 107 with opposite magnetic poles of the upper and lower permanent magnets 112*a* and 112*b* facing each other.

The positive polar section and the permanent magnets 112*a* and 112*b* are accommodated in and supported by a yoke 117. An upper pole piece 114*a* and a lower pole piece 114*b* are provided to induce rotating magnetic flux generated by the permanent magnets 112*a* and 112*b* into the activating space 107. An upper shield cup 115*a* and a lower shield cup 115*b* are tightly welded to the top of the upper pole piece 114*a* and the bottom of the lower pole piece 114*b*, respectively.

An insulating ceramic 116 is tightly and fixedly welded to a bottom of the lower shield cup 115*b* not only to seal an interior of the positive polar cylinder 101 in a vacuum state but also to prevent a dielectric breakdown phenomenon caused by a great potential difference between a bottom of the yoke 117 and the first and second terminals 104*a* and 104*b* or the first and second choke coils 105*a* and 105*b*. The center lead 110 and the side lead 111 are extended through holes formed in the insulating ceramic 116 to pass through the bottom of the yoke 117, and are connected to the first and second terminals 104*a* and 104*b*, respectively.

As shown in FIG. 2, when the magnetron 100 having the above-described construction is employed in a microwave oven 200, the magnetron 100 is disposed in a machine room 202 of the microwave oven 200 and irradiates microwaves into a cooking cavity 201 of the microwave oven 200. Parts including a high voltage transformer 204, a high voltage condenser (not shown) and a fan motor (not shown) are arranged under the magnetron 100. The insulating ceramic 116 is maintained to have a thickness of 16 mm or more so that a secure insulation distance is maintained between the bottom of the yoke 117 including the grounded lower shield cup 115*b* and the first and second terminals 104*a* and 104*b* or the first and second choke coils 105*a* and 105*b* so as to improve the efficiency of the magnetron 100 and to prevent harming the user. Further, a spaced distance of 15.5 mm or more must be maintained between the first and second terminals 104*a* and 104*b* or the first and second choke coils 105*a* and 105*b* and a bottom of the filter box 113 accommodating the first and second terminals 104*a* and 104*b* or the first and second choke coils 105*a* and 105*b*. Furthermore, a diameter of each of the first and second choke coils 105*a* and 105*b* must be taken into account. Accordingly, an entire height of the filter box 113 generally is about 43 mm or more. Further, a vibration and a noise may be generated between the filter box 113, which is magnetically connected to the upper and lower permanent magnets 112*a* and 112*b* by a magnetic force, and an outside wall of the machine room 202, so a certain distance "d" must be maintained between the bottom of the filter box 113 and the outside wall of the machine room 202 to prevent the vibration and the noise from being generated therebetween.

To maintain the above-described insulation distance and the certain distance "d", an entire length of a magnetron must be increased and a width "D" of the machine room 202 must be widened in proportion to increases in a length of the magnetron. Accordingly, a ratio of a volume of the machine room 202 to a volume of the microwave oven 200 must be greater than that of a volume of the cooking cavity 201 to the volume of the microwave oven 200. For this reason, the conventional microwave oven is problematic in that a design of the microwave oven 200 is significantly restricted. In particular, this problem is fatal to small-sized microwave ovens having a cooking cavity of a small volume.

SUMMARY OF THE INVENTION

Accordingly, it is an aspect of the present invention to provide a microwave oven in which a height of a filter box is relatively reduced, so an entire height of a magnetron can be reduced, thus implementing a miniaturization of the magnetron.

Additional aspects and/or advantages of the present invention will be set forth in part in the description which follows and, in part, will be obvious from the description, or may be learned by practice of the invention.

The above and/or other aspects are achieved by providing a magnetron for microwave ovens, including a positive polar section forming a cavity resonator, a negative polar section emitting thermions, a yoke accommodating and supporting the positive polar section, leads extended to an outside through a bottom of the yoke to be supplied with power by an outside power source, a connection part connecting the leads with the outside power source, a filter box accommodating the connection part therein, a first insulator fixedly supporting the negative polar section, being positioned between the connection part and the bottom of the yoke, and having a certain height to maintain an insulation distance between the connection part and the bottom of the yoke, and a second insulator interposed between the connection part and the bottom of the yoke to form a relatively lengthened insulation distance.

A molded insulating plate may be attached to a bottom of the filter box to reduce an insulation distance between the connection part and the bottom of the filter box.

BRIEF DESCRIPTION OF THE DRAWINGS

The above and/or other aspects and advantages of the invention will be more clearly understood from the following detailed description taken in conjunction with the accompanying drawings, in which.

DETAILED DESCRIPTION OF THE PREFERRED EMBODIMENTS

Figure 1:
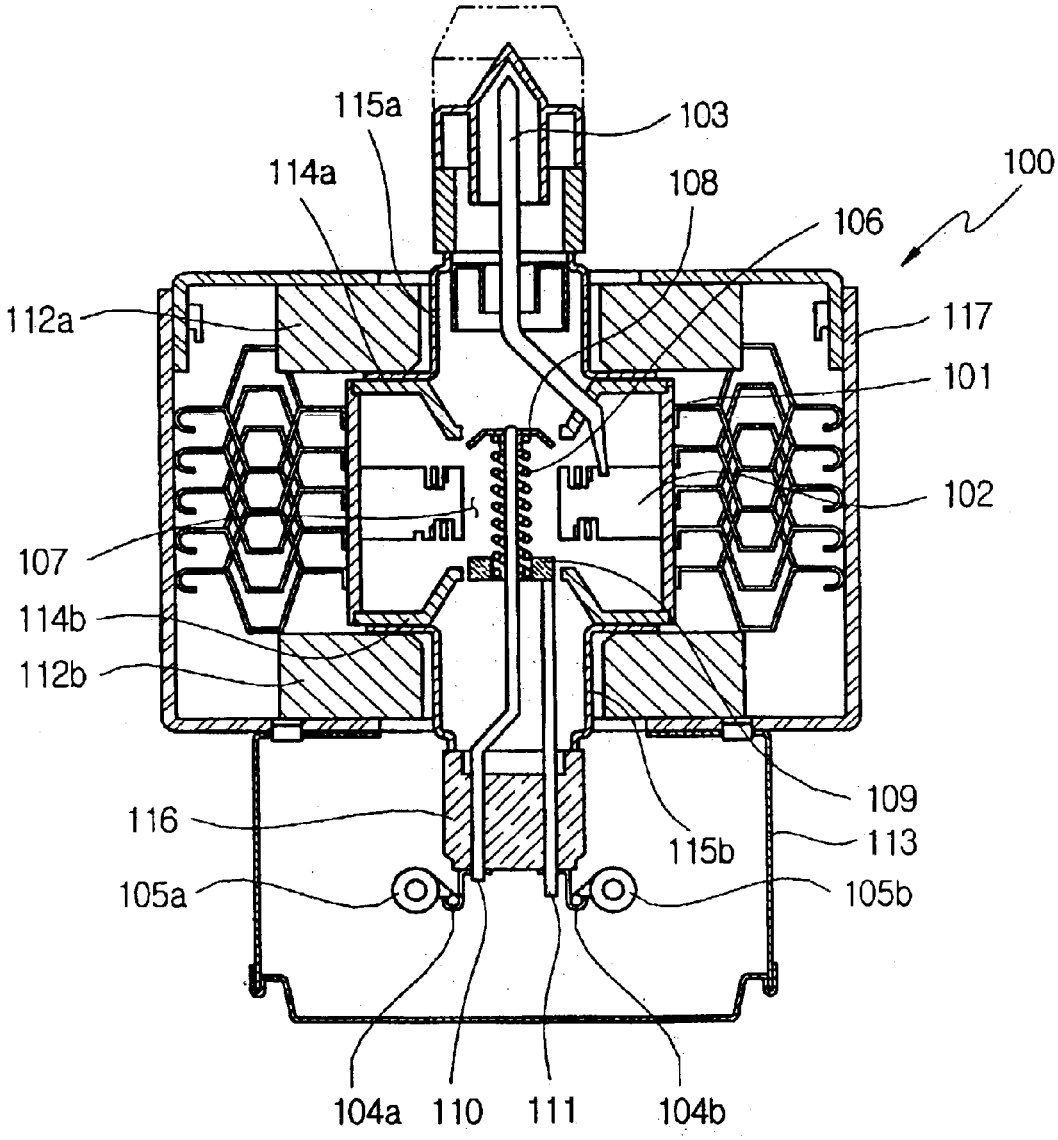
FIG. 1 (Prior Art)
FIG. 1 is a longitudinal sectional view of a conventional magnetron.
Figure 2:
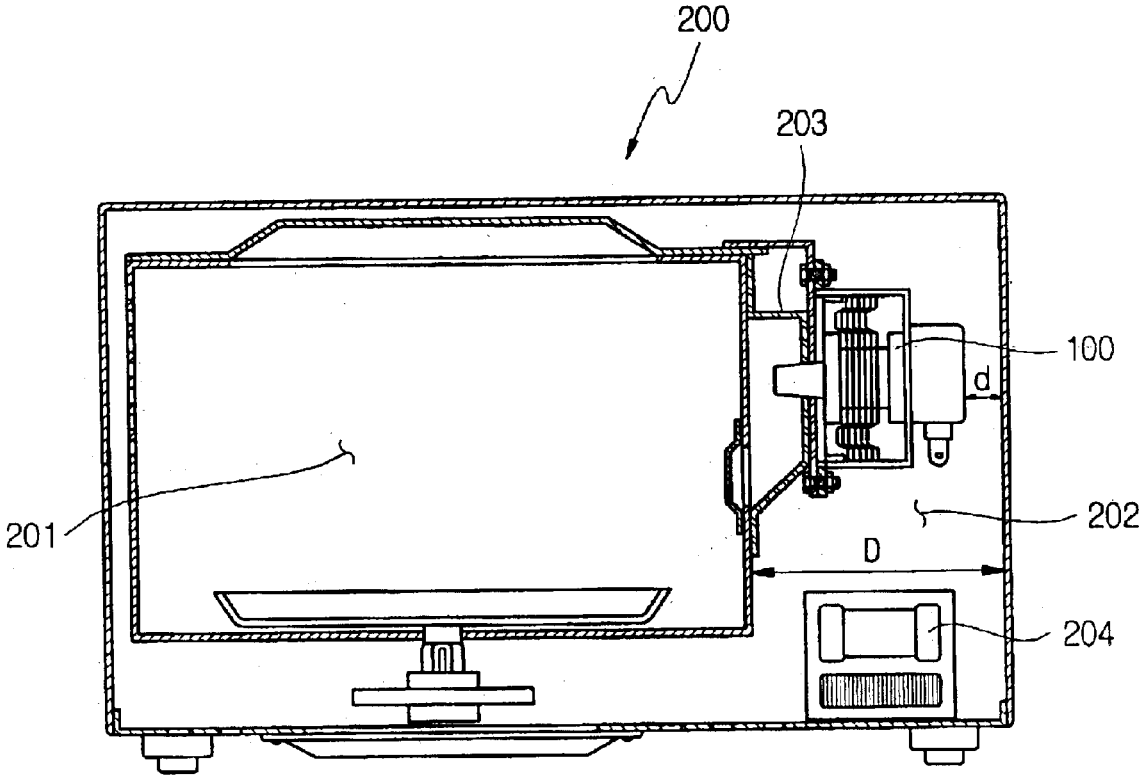
FIG. 2 (Prior Art)
FIG. 2 is a longitudinal sectional view of a conventional microwave oven.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

Figure 3:
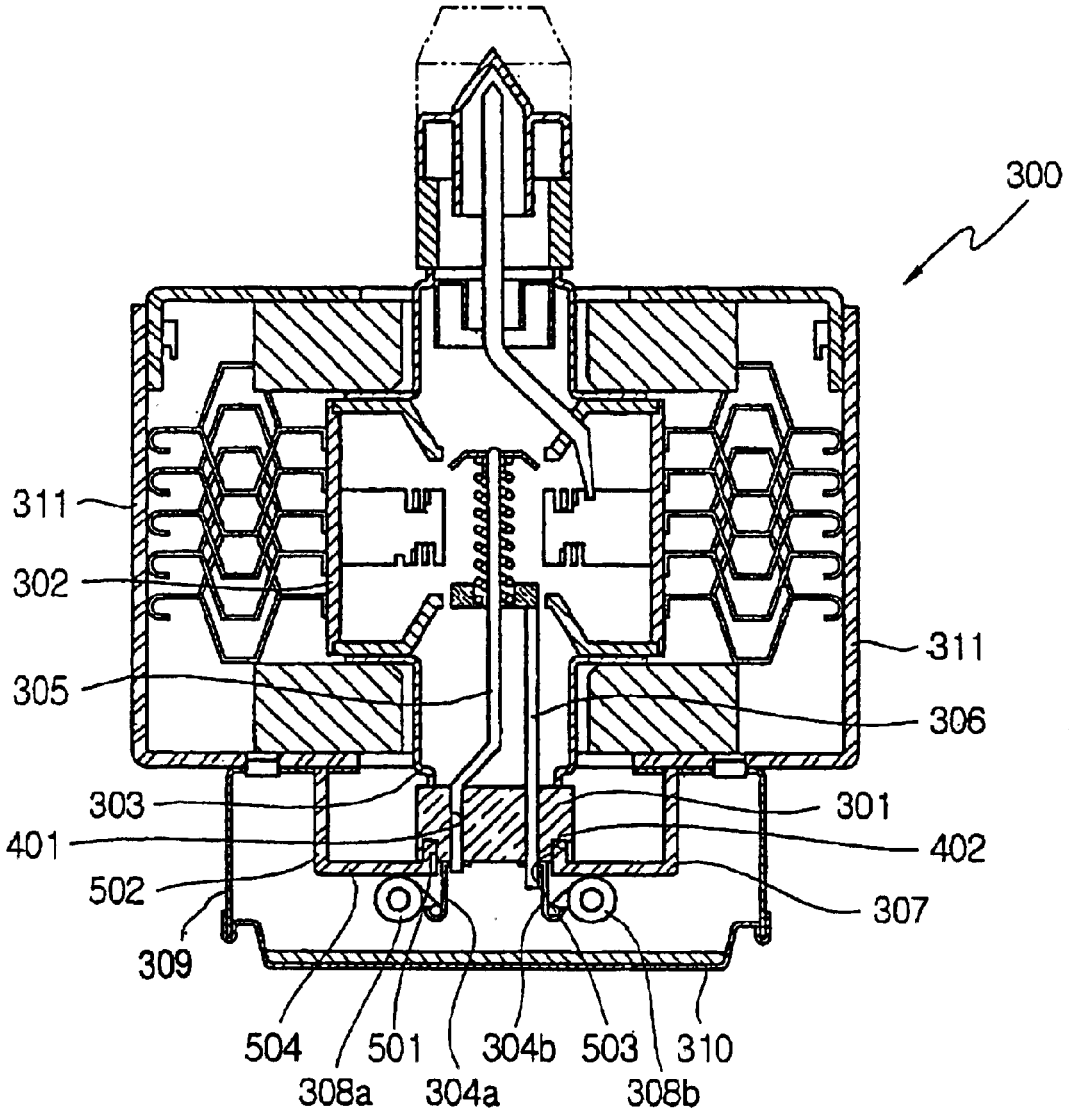
FIG. 3 is a longitudinal sectional view of a magnetron in accordance with an embodiment of the present invention.
Figure 4:
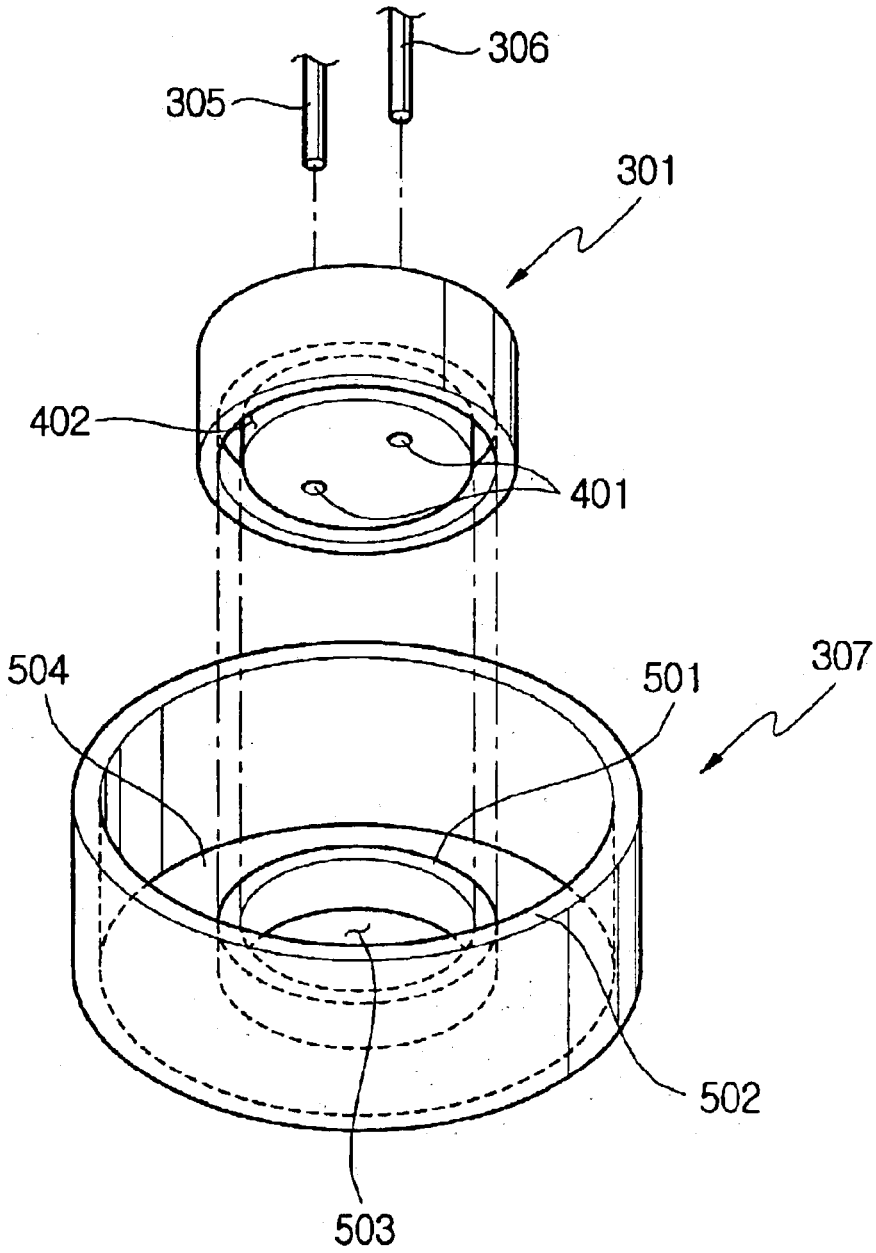
FIG. 4 is a perspective view showing the first and second insulators of FIG. 3.
Figure 5:
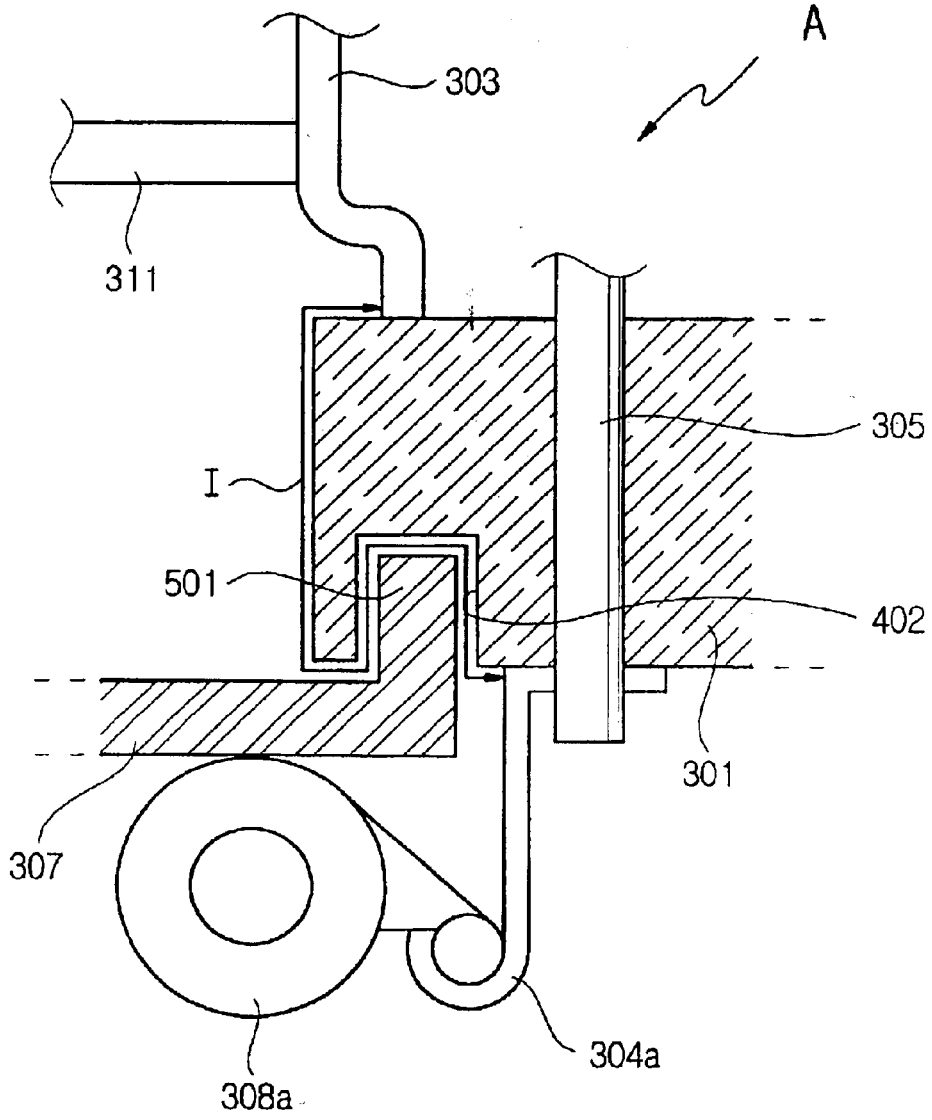
FIG. 5 is an enlarged sectional view of area A of FIG. 3.

FIG. 3 is a longitudinal sectional view of a magnetron in accordance with an embodiment of the present invention. FIG. 4 is a perspective view showing the first and second insulators of FIG. 3. FIG. 5 is an enlarged sectional view of area A of FIG. 3.

As shown in FIG. 3, in a magnetron 300, a first insulator 301 of ceramic material having a height of 8 mm is welded to a bottom of a grounded lower shield cup 303 not only to seal an interior of a positive polar cylinder 302 in a vacuum state but also to prevent a dielectric breakdown phenomenon caused by a potential difference of about 4 KV between first and second terminals 304*a* and 304*b* or between first and second choke coils 308*a* and 308*b* that are connected to a bottom of a yoke 311 including a grounded lower shield cup 303. A construction of the first insulator 301 is illustrated in detail in FIG. 4. Two through holes 401 are formed through the first insulator 301 around a center axis of the first insulator 301 to pass center and side leads 305 and 306 therethrough, and a circular groove 402 having a certain depth is formed in the first insulator 301 around the through holes 401. As shown in FIG. 3, a circular protrusion 501 formed on a second insulator 307 is fitted into the circular groove 402 of the first insulator 301. A construction of the second insulator 307 is illustrated in detail in FIG. 4. In the second insulator 307, a center opening 503 is formed at the center of a disk 504 to pass the center and side leads 305 and 306 therethrough, and the circular protrusion 501 is circumferentially extended around the center opening 503. A mounting protrusion 502 is circumferentially extended from an edge of the disk 504 and has a diameter greater than that of the circular protrusion 501 in a direction of the circumferentially extended circular protrusion 501. An upper end of the mounting protrusion 502 is fixedly attached to the bottom of the yoke 311 including the positive polar cylinder 302, as shown in FIG. 3, so that the circular protrusion 501 is fixedly fitted into the circular groove 402 of the first insulator 301. Further, the disk 504 and the mounting protrusion 502 operate as insulators that insulate a lower side of the yoke 311 from the first and second terminals 304*a* and 304*b* and the first and second choke coils 308*a* and 308*b*, as shown in FIG. 3.

With reference to FIG. 5, operations of the circular groove 402 of the first insulator 301 and operations of the circular protrusion 501, disk 504 and mounting protrusion 502 of the second insulator 307 are described below.

In a case where a dielectric is inserted into a gap between two terminals having a certain potential difference, if the potential difference between the two terminals is considerably great, there occurs a dielectric breakdown phenomenon in which the dielectric is broken down and a current flows between the two terminals by a movement of ions. A degree to which a dielectric can resist the dielectric breakdown phenomenon is referred to as a dielectric strength. The dielectric strength is proportional to a dielectric constant. The dielectric constant of air is about 1, and air has a smallest dielectric constant of dielectrics. The dielectric breakdown generally occurs at a position where an electrical insulation distance is relatively short and a potential difference is relatively great. In the magnetron 300, the dielectric breakdown occurs between the bottom of the yoke 311 and a connection part (including the first and second terminals 304*a* and 304*b* and the first and second choke coils 308*a* and 308*b*) and between a side and/or a bottom of the filter box 309 and the connection part. In this case, if a pointed portion exists, an electric field is concentrated on the pointed portion, thus causing the dielectric breakdown to easily occur.

In general, air, which is a dielectric having a dielectric constant of 1, is inserted into spaces between ground points (including the bottom of the yoke 311 and the filter box 309) and the connection part (including the first and second terminals 304*a* and 304*b* and the first and second choke 308*a* and 308*b* coils). A secure insulation distance that can prevent dielectric breakdown in the air can be presumed to be about 16 mm. If a dielectric "A" having a relatively high dielectric strength is positioned in a space constituting an insulation distance, the insulation distance is not a straight distance but a distance that is lengthened around the dielectric "A" through a space occupied by the air. The reason for this is that the dielectric breakdown cannot easily occur in the dielectric "A" having the relatively high dielectric strength but can occur in the air having a relatively small dielectric strength and, in this case, the insulation distance and the dielectric strength can be mathematically calculated.

Further, in FIG. 5, an insulation distance in a construction of FIG. 3 is illustrated in detail.

An insulation distance between the bottom of the yoke 311 and the connection part is shown in FIG. 5. That is, an insulation distance between the lower shield cup 303 having a ground point closest to the first and second terminals 304*a* and 304*b* or the first and second choke coils 308*a* and 308*b* and the first and second terminals 304*a* and 304*b* or the first and second choke coils 308*a* and 308*b*, is lengthened by a fitting structure in which the circular protrusion 501 of the second insulator 307 is fitted into the circular groove 402 of the first insulator 301. A lengthened insulation distance "l" is indicated by an arrow line in FIG. 5. Since the lengthened insulation distance "l" may be maintained to be about 16 mm so as to prevent the dielectric breakdown, a depth of the circular groove 402 and a height of the circular protrusion 501 may be so designed such that the lengthened insulation distance "l" is maintained to be about 16 mm. Although in this embodiment, the circular groove 402 is shown as a single circular groove 402 and the circular protrusion 501 is shown as a single circular protrusion 501 corresponding to the single circular groove 402, a plurality of circular grooves and a plurality of circular protrusions corresponding to the circular grooves are formable in the first and second insulators 301 and 307, respectively, so as to further reduce a height of the first insulator 301.

Further, as shown in FIG. 3, to reduce a spaced distance between the first and second terminals 304*a* and 304*b* or the first and second choke coils 308*a* and 308*b* and the bottom of the filter box 309, that is, an insulation distance therebetween, a molded insulating plate 310 is attached to the bottom of the filter box 309. Further, the first and second terminals 304*a* and 304*b* and the first and second choke coils 308*a* and 308*b* are maintained at a high temperature ranging from about 200° C. to about 300° C., so that the molded insulating plate 310 may be made of material having a high thermal resistance to resist the high temperature.

A height of the filter box 309 of the magnetron 300 constructed in accordance with the embodiment of the present invention is reduced to about 23 mm.

As apparent from the above description, a magnetron, in which a filter box thereof occupying about 40% of a height of the magnetron is significantly reduced in height, so a miniaturization of the magnetron can be implemented and a design of a product including the magnetron, such as a microwave oven, can be carried out, thus allowing an appearance of a product to be variously designed.

For example, protrusions may be formed in the first insulator and a circular groove may be formed in the second insulator. That is, although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A magnetron for microwave ovens, comprising:

a positive polar section forming a cavity resonator;

a negative polar section emitting thermions;

a yoke accommodating and supporting the positive polar section;

leads extended to an outside through a bottom of the yoke to be supplied with power by an outside power source;

a connection part connecting the leads with the outside power source;

a filter box accommodating the connection part therein;

a first insulator fixedly supporting the negative polar section, being positioned between the connection part and the bottom of the yoke, and having a height to maintain an insulation distance between the connection part and the bottom of the yoke; and a second insulator interposed between the connection part and the bottom of the yoke to form a lengthened insulation distance for dielectric breakdown in comparison to a distance between the connection part and the bottom of the yoke.

2. The magnetron as set forth in claim 1, wherein the first insulator is made of ceramic material.

3. The magnetron as set forth in claim 1, wherein the second insulator is made of ceramic material.

4. The magnetron as set forth in claim 3, wherein:

the first insulator is provided with at least one circular groove that is formed in a lower portion of the first insulator to be downwardly open, and the second insulator is provided with at least one circular protrusion that is fitted into the at least one circular groove of the first insulator to lengthen the insulation distance between the bottom of the yoke and the connection part.

5. The magnetron as set forth in claim 4, wherein the lengthened insulation distance is more than 16 mm.

6. The magnetron as set forth in claim 4, wherein the second insulator further comprises:

a shield portion that blocks the connection part from the bottom of the yoke, the yoke being electrically reactable with the connection part.

7. The magnetron as set forth in claim 6, wherein the shield portion comprises:

a disk integrated with the at least one circular protrusion; and a mounting protrusion extended from the disk in a direction of protrusion of the at least one circular protrusion and fixed to the yoke.

8. The magnetron as set forth in claim 1, further comprising;

an insulating plate attached to a bottom of the filter box to reduce a distance between the connection part and the bottom of the filter box.

9. The magnetron as set forth in claim 8, wherein the insulating plate is made of a material having a high heat resistance.

10. The magnetron as set forth in claim 8, wherein the insulating plate is made of a material having a high dielectric strength.

11. The magnetron as set forth in claim 8, wherein the insulating plate is molded.

12. A magnetron for microwave ovens, comprising:

a positive polar section forming a cavity resonator;

a negative polar section emitting thermions;

a yoke accommodating and supporting the positive polar section and determining an amount of magnetic flux;

leads extended to an outside through a bottom of the yoke to be supplied with power by an outside power source;

a connection part connecting the leads with the outside power source;

a filter box accommodating the connection part therein; and a molded insulating plate attached to a bottom of the filter box to reduce a distance between the connection part and the bottom of the filter box.

13. The magnetron as set forth in claim 12, wherein said insulating plate is made of a material having a high heat resistance.

14. The magnetron as set forth in claim 12, wherein said insulating plate is made of a material having a high dielectric strength.

15. A magnetron for microwave ovens including a positive polar section forming a cavity resonator, a negative polar section emitting thermions, and a yoke accommodating and supporting the positive polar section, comprising:

first and second leads extending through a bottom of the yoke to be supplied with power by a power source;

a connection part connecting the first and second leads with the power source;

a box accommodating the connection part therein;

a first insulator fixedly supporting the negative polar section, being positioned between the connection part and the bottom of the yoke; and a second insulator interposed between the connection part and the bottom of the yoke such that an insulation distance for a dielectric breakdown is formed between the first and second insulators, the first and second insulators are shaped such that the insulation distance for a dielectric breakdown is greater than a distance between the bottom of the yoke and the connecting part.

16. The magnetron as set forth in claim 15, wherein one or both of the first and second insulators are made of a ceramic material.

17. The magnetron as set forth in claim 15, wherein:

the first insulator is provided with one circular groove thereon; and the second insulator is provided with one circular protrusion corresponding to the one circular groove of the first insulator to lengthen the insulation distance according to a height and a width of the one circular groove.

18. The magnetron as set forth in claim 17, wherein:

the first insulator is provided with at least one other circular groove thereon; and the second insulator is provided with at least one other circular protrusion corresponding to the at least one other circular groove of the first insulator to further lengthen the insulation distance according to a height and a width of the at least one other circular groove.

19. The magnetron as set forth in claim 16, wherein the lengthened insulation distance is more than 16 mm.

20. The magnetron as set forth in claim 15, wherein the second insulator further comprises;

a shield portion that shields the connection part from the bottom of the yoke, the yoke being electrically reactable with the connection part.

21. The magnetron as set forth in claim 20, wherein the shield portion comprises:

a disk with the one circular protrusion; and a mounting protrusion extended from the disk in a direction of protrusion of the one circular protrusion and fixed to the yoke.

22. The magnetron as set forth in claim 15, further comprising;

an insulator attached to and covering a bottom of the box to reduce a distance between the connection part and the bottom of the box.

23. A magnetron for microwave ovens including a positive polar section forming a cavity resonator, a negative polar section emitting thermions, and a yoke accommodating and supporting the positive polar section and determining an amount of magnetic flux, comprising:

first and second leads extending through a bottom of the yoke to be supplied with power by a power source;

a connection part connecting the first and second leads with the power source;

a box accommodating the connection part therein; and an insulator attached to and covering a bottom of the box to reduce a distance between the connection part and the bottom of the box.

24. The magnetron as set forth in claim 23, wherein the insulator is made of a high heat resistance material.

25. The magnetron as set forth in claim 23, wherein the insulator is made of a high dielectric strength material.

26. A magnetron for microwave ovens with a casing, comprising:

first and second leads; and first and second insulators interposed between and insulating the first and second leads from a bottom of the casing, the first and second insulators having respective and corresponding circular grooves and circular protrusions;

wherein the first and second leads are extended through and are insulated from the casing and are supplied by a high voltage power source such that a first voltage level is provided across the first and second leads, the casing being maintained at a second voltage level with respect to the first lead, and an insulating distance for a dielectric breakdown is greater than a smallest distance between the casing and one of the first and second leads to insulate the first and second leads from the casing when the smallest distance between the casing and one of the first and second leads causes a dielectric breakdown.

27. A magnetron for microwave ovens with a casing, comprising:

first and second leads;

first and second insulators interposed between and insulating the first and second leads from a bottom of the casing, the first and second insulators having respective and corresponding circular grooves and circular protrusions;

a connection part connected to the first and second leads to connect a high voltage supply thereto; and a box covering the connection part, wherein:

the first and second leads are extended through and are insulated from the casing and are supplied by a high voltage supply such that a first voltage level is provided across the first and second leads, the casing is maintained at a second voltage level with respect to the first lead, and an insulating distance for a dielectric breakdown between the casing and the connection part is greater than a smallest distance between the casing and the connection part to reduce a height of the box by reducing a height of the first and/or second insulators.

28. A magnetron for microwave ovens including a positive polar section forming a cavity resonator, a negative polar section emitting thermions, and a yoke accommodating and supporting the positive polar section, comprising:

first and second leads extending through a bottom of the yoke to be supplied with power by a power source;

a connection part connecting the first and second leads with the power source;

a box accommodating the connection part therein;

a first insulator fixedly supporting the negative polar section, being positioned between the connection part and the bottom of the yoke; and a second insulator interposed between the connection part and the bottom of the yoke such that a dielectric breakdown path is formed between the first and second insulators, the first and second insulators are shaped such that the insulation distance for a dielectric breakdown is greater than a distance between the yoke and the connection part.

29. A magnetron for microwave ovens including a positive polar section forming a cavity resonator, a negative polar section emitting thermions, and a yoke accommodating and supporting the positive polar section, comprising:

first and second leads extending through a bottom of the yoke to be supplied with power by a power source;

a connection part connecting the first and second leads with the power source;

a box accommodating the connection part therein;

a first insulator fixedly supporting the negative polar section, being positioned between the connection part and the bottom of the yoke; and a second insulator interposed between the connection part and the bottom of the yoke such that by only changing corresponding shapes of the first and second insulators, respectively, an insulation distance for a dielectric breakdown is changeable.

30. A magnetron for microwave ovens including a positive polar section forming a cavity resonator, a negative polar section emitting thermions, and a yoke accommodating and supporting the positive polar section, comprising:

first and second leads extending through a bottom of the yoke to be supplied with power by a power source;

a connection part connecting the first and second leads with the power source;

a box accommodating the connection part therein; and a fitting structure to lengthen a insulation distance for a dielectric breakdown between the bottom of the yoke and the connecting part by forming respective and corresponding circular grooves and circular protrusions in first and second insulators so that a height of the fitting structure is reducible without causing the dielectric breakdown between the bottom of the yoke and the connecting part.

* * * * *